United States Patent [19]

Villard et al.

[11] 4,242,039

[45] Dec. 30, 1980

[54] PUMP IMPELLER SEALS WITH SPIRAL GROOVES

[75] Inventors: Jean-Claude Villard, Echirolles; Gilbert Berthereau, Eybens, both of France

[73] Assignee: L'Air Liquide, Societe Anonyme pour l'Etude et l'Exploitation des Procedes Georges Claude, Paris, France

[21] Appl. No.: 962,032

[22] Filed: Nov. 15, 1978

[30] Foreign Application Priority Data

Nov. 22, 1977 [FR] France ..... 77 35036

[51] Int. Cl.[3] ..... F04D 29/16

[52] U.S. Cl. ..... 415/112; 415/140; 415/169 A; 415/170 B

[58] Field of Search ..... 415/112, 113, 169 A, 415/170 A, 170 B, 173 A, 106, 140

[56] References Cited

U.S. PATENT DOCUMENTS

| | | | |
|---|---|---|---|
| 3,137,237 | 6/1964 | Zagar et al. | 415/113 |
| 3,467,449 | 9/1969 | Muijderman | 415/169 A |
| 3,535,051 | 10/1970 | Turner | 415/212 R |
| 3,578,874 | 5/1971 | Sproule | 415/170 A |

FOREIGN PATENT DOCUMENTS

| | | | |
|---|---|---|---|
| 708593 | 7/1941 | Fed. Rep. of Germany | 415/169 A |
| 1505487 | 12/1967 | France | 415/169 A |
| 182519 | 11/1966 | U.S.S.R. | 415/169 A |

*Primary Examiner*—Everette A. Powell, Jr.
*Assistant Examiner*—A. N. Trausch, III
*Attorney, Agent, or Firm*—Young & Thompson

[57] ABSTRACT

The present invention relates to internal and shaft outlet seals of a pump. On both sides of a paddle-wheel are arranged a pair of coaxial discs (22–23) and (24–25), the face of one disc being smooth and the face of the other disc having spiral grooves, one of the discs of each pair being interlocked in rotation with wheel 5, whereby the liquid between two discs is subjected to a pressure increase radially outwardly compensating at least for the pressure increase due to pumping by wheel 5.

9 Claims, 4 Drawing Figures

PUMP IMPELLER SEALS WITH SPIRAL GROOVES

The present invention relates to a pump of the paddle-wheel type and mounted on a driving shaft and placed in a housing, each blade forming a passage way extending on one side into an axial wheel body and emerging opposite a suction pipe and on the other side radially into a wheel center with a radial extension running opposite a tangential delivery pipe.

The pumps known at present are sealed at their suction pipe, between wheel and housing (so-called internal sealing) and at the point where the shaft exits through the housing, by a labyrinth configuration of one of the parts (fixed or rotating) in relation to the other, generally associated with seals made from a material resisting friction wear. Despite these arrangements, fairly frequent changes of seals are required, all the more frequently when the liquid pumped is at a temperature very different from the ambiant temperature, whether it is very hot or very cold. Furthermore, the sealing defects, particularly of internal sealing, lead to leaks which are generally "recirculated" to the suction side of the pump, which is an obstacle to the attainment of a good pumping efficiency.

One aim of the invention aims at providing pump seals which are particularly efficient in that they prevent without fail undesirable leaks, which improves the efficiency, and which moreover have practically zero wear by friction, which confers on the pump thus equipped a very long service life and, at the same time, leads to a particularly reduced maintenance; a pump according to the invention presents very great safety in use.

The pump of the invention is characterized in that the pump wheel is mounted with a slight axial clearance and in that the disc of the suction sealing device is end-mounted on an axially resilient and sealed hub, such as a bellows, fixed to the housing around a suction passage of said housing. The invention represents then a transposition and a special adaptation to the pumps of the technique of spiral groove bearings which has been proposed up to now essentially to serve as an axial stop for a shaft subjected to a substantial axial thrust, which is the case generally with most pumps and turbines, or shaft support. This technique is described in several publications, particularly in an article entitled "Nouvelles formes de paliers: les paliers à gaz et à rainure spirale" par E. A. MUIJDERMAN which appeared in the "Revue Technique PHILIPS", volume 25, 1963/64 No. 9—Page 245 to 266. Briefly, this technique consists in "pumping" a fluid, which is generally a gas, radially towards the center of the two discs, which causes the discs to move apart, so that the supporting of the rotating mobile part is achieved through the fluid in question. One merit of the present invention is to have recognized the advantage of this technique for ensuring the seals of a pump through the use, as sealing fluid, of the very liquid to be pumped, and to provide the special adaptations for this application which consist particularly in causing a centrifugal increase of the pressure of the sealing fluid, which determines a particular direction of rotation of the smooth disc in relation to the spiral grooved disc, (whereas the centifugal or centripetal direction, of the pumping effect is immaterial in the axial thrust stop and shaft supporting applications) and in proportioning this pressure increase by constructional procedures resulting from relatively complex calculations and experiments, so that it corresponds substantially to the pressure increase due to the pumping effect. In this way, the counter-pressure thus developed at the location of the junctions, when the wheel is rotating, ensures complete stoppage of the leaks without any wear of the parts rotating in relation to each other, which are separated by a thin liquid film overflowing from the spiral grooves and coming between the projecting bearing surfaces between the grooves of the spiral grooved disc and the smooth face of the other facing disc, whereas a certain friction of the parts takes place exclusively at the times of starting up and of stopping the pump and whereas leaks along the grooves may take place when stopped, if certain technical measures detailed further on, also in accordance with the invention, are not implemented. This process is particularly useful in the field of cryogenic pumps for avoiding solid friction junctions undergoing considerable thermal stresses. Furthermore, the starting up of a cryogenic pump is made easier and moe rapid with the hydrodynamic junctions described. In addition, the shafts of the motor and of the pump have no need to be aligned as rigorously as in conventional moto-pump sets and, if so desired, the supporting of the pump by the motor unit may be emitted, which reduces the heat losses by conduction along this support. It will also be understood that the technique of pump construction is considerably simplified at the same time as their weight is reduced.

The characteristics and advantages of the invention will become evident moreover from the description which follows, given by way of example, with a reference to the accompanying drawings in which.

Figure 1:
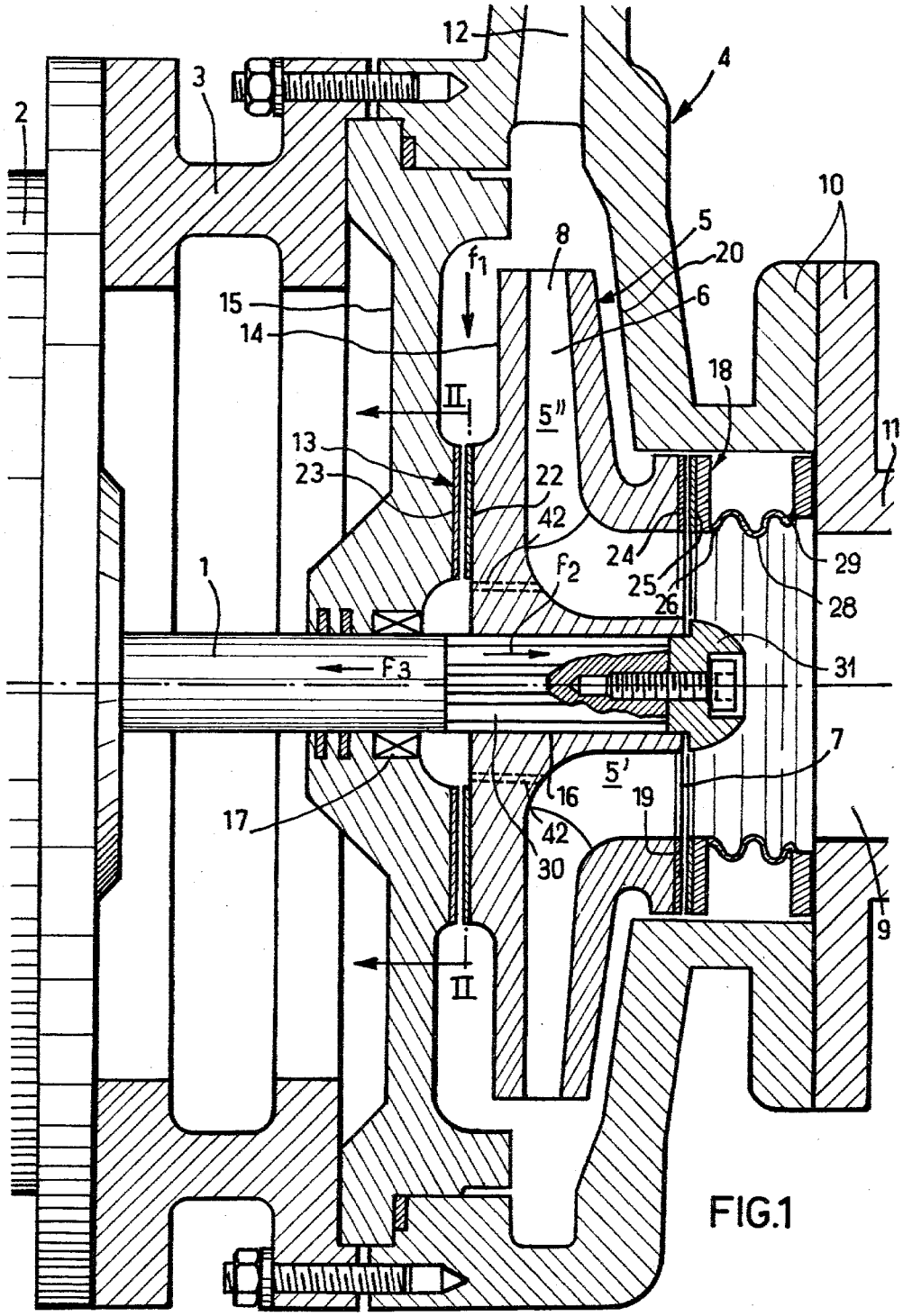
FIG. 1 is a view in axial section of a pump according to the invention.
Figure 2:
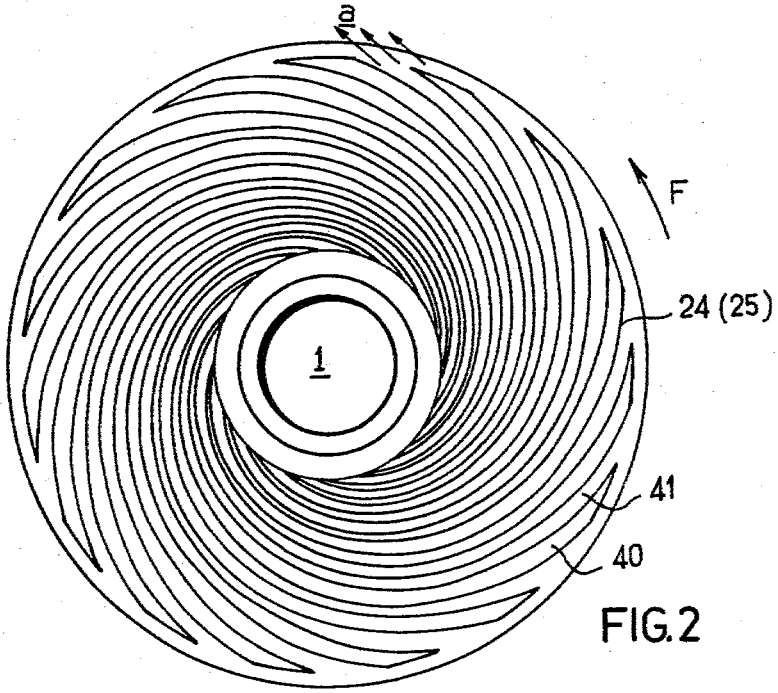
FIG. 2 is a view on a larger scale along line II—II of FIG. 1.

Referring to FIGS. 1 and 2, a cryogenic pump comprises a shaft 1 of a motor 2 extending through a support 3 towards a pump housing 4, wherein shaft 1 receives, at its end, a paddle-wheel 5 forming a plurality of blades constituted by identical conduits 6 disposed about shaft 1 and having an axial suction part 7 in a wheel body 5' situated proximate shaft 1 and a radial delivery part 8 in a wheel center 5" with a radial extension. The suction parts 7 emerge opposite an opening 9 in the housing, on which is fixed, by flange 10, a supply pipe 11. The delivery parts 8 emerge into the pump housing 4 while travelling past a tangential delivery pipe 12.

The paddle-wheel 5 is associated with two principal sealing means. One of these means, designated generally by 13, is situated on the "shaft output" side and serves to prevent liquid leaks flowing between a front wall 14 of paddle-wheel 5 and a transverse wall 15 of the pump housing 4 (along arrow $f_1$) and between shaft 1 and a hub 16 of paddle-wheel 5 towards the suction (along arrow $f_2$) and accessorily along shaft 1 outwards (according to arrow $f_3$). The other sealing means, designated generally by 18, is situated on the "suction side" of the pump and serves to avoid liquid recirculation leaks which might occur between one end 19 of paddle-wheel 5 and another wall 20, incorporating the suction opening 9, of pump housing 4.

The two sealing means 13 and 18 are both formed from two facing radial annular discs 22 and 23 for sealing means 13 and 24, 25 for sealing means 18. Discs 22 and 24 are integral with paddle-wheel 5, whereas discs 23 and 25 are fixed against rotation, disc 23 being fixed to the wall of housing 15, whereas disc 25 is sealingly fixed, preferably by its inner periphery 26, to one end of a bellows 28, the other end of which 29 is fixed to the housing wall 20 at the periphery of the suction opening 9.

Each pair of discs 22 and 23 on the one hand and 24, 25 on the other must be able to come into contact facet to face and to move apart a little from each other and that simultaneously and in the same direction for both pairs of discs 22 and 23, 24 and 25. For this purpose, since disc 23 is not only secured against axial rotation, but also against axial translation, since it is integral with housing wall 15, the paddle-wheel 5 is mounted with a slight axial movement on shaft 1 through splines 30, preventing however any motion in rotation relative to shaft 1, this axial movement being moreover limited by a stop 31 screwed to a greater or lesser extent on the end of shaft 1. As far as the pair of discs 24, 25 are concerned, since disc 24 integral with paddle-wheel 5 is not only mobile in rotation, but also undergoes axial movements equal to and concomitant with those of disc 22, i.e. in a direction which is opposite that desired for disc 24 facing disc 25, this latter disc 25 is provided with a fairly high range of movement owing to the presence of bellows 28. It should be noted that it is only when the pump is stopped, when the paddle-wheel 5 ceases to rotate, that discs 22 and 23 on the one hand, 24 and 25 on the other must come close to one another until their faces bear one against the other. This drawing together is provided for disc 22 normally by the thrust effect exerted on the paddle-wheel 5 in the direction of motor 2 due, at rest, to the effect of pressure—even residual—on the axial suction part 7 and for disc 25 by the effect of pressure exerted at the end of running by the delivery pressure, even residual, in pump housing 4. It is to be noted that this pressure effect is exerted on discs 22 (in the direction of disc 23) and 25 (in direction of disc 24) not only at the end of a pumping operation, but also and moreover in a pronounced fashion during the pumping operation, for on the one hand there is added, in paddle-wheel 5, to the effect of static pressure on axial suction part 7, the dynamic effect of circulation of the liquid in conduits 6 which is exerted inthe same direction; whereas on the other hand the delivery pressure is exerted fully over the whole face of disc 25 because bellows 28 is fixed along its internal periphery (whereas a bellows of a larger diameter would have reduced this effect, for it would have caused on a radially interior part of disc 25 the only suction pressure several times less than the delivery pressure). But this pronounced pressure effect tending to bring discs 22 and 23 on the one hand, 24 and 25 on the ohter closely together vies with another effect which will now be explained, so that it is precisely during the rotation of paddle-wheel 5 that disc 22 moves away from disc 23 and disc 25 from disc 24.

In fact, for each pair of discs 22, 23 and 24, 25, the rotating disc 22 (or 24) has one face opposite the other disc, which is quite smooth, whereas in the face of the other disc 23 or 25 respectively which is fixed in rotation there has been formed a plurality of spiral-shaped grooves 40 (see FIG. 2) with a depth equal to a few hundredths of a millimeter, defining therebetween, an equal number of projecting spiral bearing surfaces 41 which, advantageously, have the same transverse area as grooves 40.

In a way known per se, as was explained above, a rotation in the direction of arrow F of the disc mobile in rotation (22 or 24) in relation to the disc fixed in rotation (23 or 25 respectively) causes an important pumping effect on the liquid in accordance with arrows a and a considerable increase of the pressure from the internal periphery (where this pressure is equal to the sunction pressure) towards the external periphery (where the pressure which prevails is the delivery pressure). It is known that this pressure increase depends on different parameters, more especially on the nature and in particular the viscosity of the liquid, the number and the shape of the grooves (which always have however a logarithmic trend) and the speed of rotation (which is here imposed by the motor operating substantially at a constant speed). Thus there can be determined, by calculation and by tests, a pressure increase such that it is at least equal to and in any case little greater than the real increase of pressure due to the paddle-wheel 5 from the suction pressure to the delivery pressure. In such a case, during operation of the pump, no leak can occur between the high pressure delivery side and the low pressure suction side along the two possible paths which have been equipped with the sealing means previously described. At rest, the dynamic effect on the liquid between the discs ceases, but as previously indicated, the paddle-wheel tends to stop in a position which applies disc 22 against disc 23 and disc 25 against disc 24 thus ensuring satisfactory although partial sealing, for the spiral grooves then form as many passage ways for leaks having however a high pressure drop both because of their extension due to the spiral shape and their very small depth. It will be noted that one or more channels 42 may be provided assuring a sufficient liquid supply for starting up. Of course, the shaft sealing means described also serves for receiving the axial thrust exerted on the paddle-wheel, thus doing away with the need for any other arrangement for this purpose.

Figure 3:
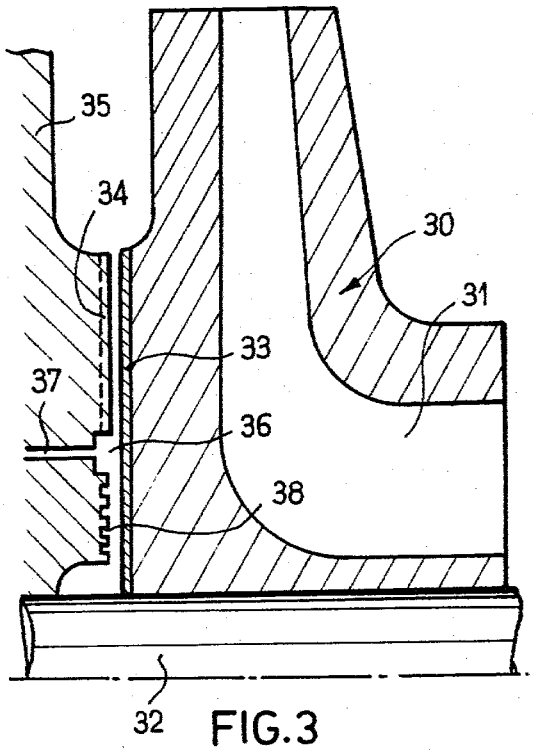
FIG. 3 is a view in axial section of another embodiment.

In FIG. 3, which is an improved version of FIG. 1, a wheel 30 with passages 31, mounted on a shaft 32 is equipped, on the shaft output side, with a pair of discs 33 and 34; disc 33 is smooth and extends over a fairly large radial extension of wheel 30 from the periphery of shaft 32. On the contrary, the spiral-disc has a smaller radial extent and is situated opposite an outer peripheral part of disc 33. Along one radially interior edge of disc 34 there is provided in a wall 35 of a pump housing, an annular groove 36 coaxial with shaft 32 into which emerges a passage 37 connected to an external gas source. Beyond groove 36, in the direction of shaft 32, there is provided in the housing wall 35 a succession of labyrinthine grooves 38. Thus, there may be prevented in any case any entry of air towards discs 33–34, which would be detrimental in the case of pumping of cryogenic liquid (due to the risk of blockage by solid condensation of water vapour, or the carrying along of dangerous impurities in the case of liquid oxygen pumping, for example) by forming by blowing-in "hot" gas (which would come from a gaseous phase of the pumped liquid for example) a stopper against any entry of air likely to be sucked in from the outside atmosphere via the shaft outlet. It will be noted that during operation of the pump, the labyrinthine junction 38 avoids too great a leak of gas towards the outside.

Figure 4:
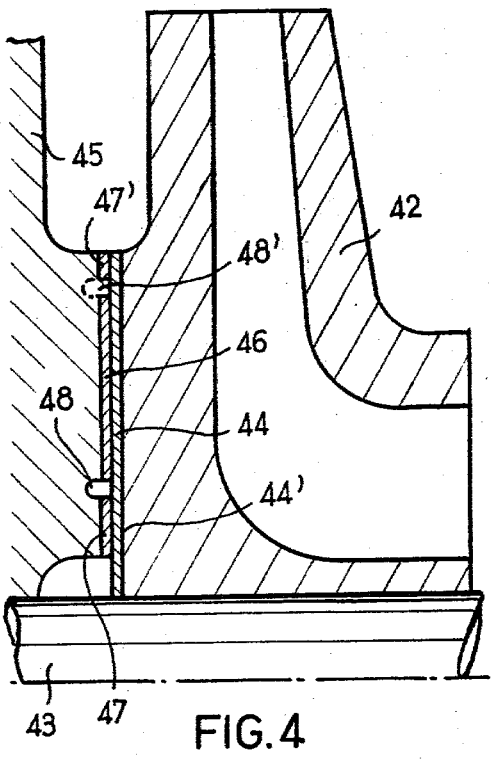
FIG. 4 is a schematical view in axial section of a further embodiment.

According to another embodiment shown in FIG. 4, a paddle-wheel 42 is here equipped, on the outlet side of shaft 43, with a smooth rotary disc 44 having a wide radial extent, whereas a housing wall 45 is here equipped with a grooved disc 46 extending radially over a radially outer part of smooth disc 44, while facing the remaining radially interior part 44' of smooth disc 44 there is formed, on housing wall 45, a smooth bearing surface 47 forming a good seal when the pump is stopped, parts 46 and 47 being separated by a groove 48. Thus is obtained a better seal when the pump is stopped by the face of the radially interior part 44' of disc 44 bearing against the face of bearing surface 47. As a variation, this bearing surface 47 may be arranged radially on the outside of the spiral-grooved disc 46 as shown at 47'.

The invention applies to all wheel-type pumps, or turbopumps for conveying liquids and more particularly cryogenic liquids.

What is claimed is:

1. A pump comprising a housing having an axial inlet and a peripheral outlet, an axial drive shaft rotatable in the housing, a paddle wheel impeller on the drive shaft having a plurality of outwardly extending passageways for the receipt of liquid from said inlet and the discharge of liquid to said outlet upon rotation of the drive shaft and impeller, and a hydrodynamic seal on each axial side of the impeller, each seal comprising a pair of confronting discs disposed peripendicular to the axis of the pump, one disc of each pair being fixed against rotation relative to the housing and the other disc of each pair being mounted for rotation on the impeller, one of said discs of each pair having spiral grooves thereon, and a bellows fixed to the housing and surrounding said inlet, one of said fixed discs being carried by said bellows, said impeller being mounted on said drive shaft for limited axial sliding movement relative to the drive shaft.

2. A pump as claimed in claim 1, the last-named disc being secured to the bellows by the radially inner periphery of the last-named disc.

3. A pump as claimed in claim 1, the other disc of each said pair of discs being smooth.

4. A pump as claimed in claim 3, in which the spirally grooved disc of each said pair has a further smooth radial part adapted to come into contact with a facing part of the smooth disc.

5. A pump as claimed in claim 4, in which said smooth part of the spirally grooved disc is situated closer to the shaft than the spirally grooved part of the disc.

6. A pump as claimed in claim 4, in which the smooth part of the spiral disc is situated at a greater radial distance from the shaft than the spirally grooved part of the disc.

7. A pump as claimed in claim 3, in which the smooth disc is on the impeller and the spirally grooved disc is fixed against rotation relative to the housing.

8. A pump as claimed in claim 1, in which one disc of each pair of discs has an annular groove therein, means for connecting said annular groove to a source of gas under pressure, and labyrinthine sealing grooves in said annularly grooved disc radially inwardly of said annular groove.

9. A pump as claimed in claim 1, and a perforation extending through a radially inner portion of the impeller between at least one of said passages and the side of the impeller that is axially opposite said inlet.

* * * * *